US006892766B2

(12) United States Patent
Bryn et al.

(10) Patent No.: US 6,892,766 B2
(45) Date of Patent: May 17, 2005

(54) LOOM AND METHOD OF WEAVING THREE-DIMENSIONAL WOVEN FORMS WITH INTEGRAL BIAS FIBERS

(75) Inventors: Leon Bryn, Huntingdon Valley, PA (US); Samir A. Nayfeh, Somerville, MA (US); M. Amirul Islam, Alburtis, PA (US); William L. Lowery, Jr., Barto, PA (US); Herbert D. Harries, III, Emmaus, PA (US)

(73) Assignee: Bally Ribbon Mills, Bally, PA (US)

( * ) Notice: Subject to any disclaimer, the term of this patent is extended or adjusted under 35 U.S.C. 154(b) by 0 days.

(21) Appl. No.: 10/790,971

(22) Filed: Mar. 2, 2004

(65) Prior Publication Data

US 2004/0168738 A1 Sep. 2, 2004

Related U.S. Application Data

(62) Division of application No. 09/956,641, filed on Sep. 20, 2001, now Pat. No. 6,742,547.

(60) Provisional application No. 60/234,036, filed on Sep. 20, 2000.

(51) Int. Cl.[7] ..... D03D 41/00

(52) U.S. Cl. ..... 139/11; 139/DIG. 1; 139/435.1; 139/435.3; 139/438; 139/448

(58) Field of Search ..... 139/DIG. 1, 11, 139/383 R, 435.1, 435.3, 438, 444, 445, 446, 447, 448; 442/205–207

(56) References Cited

U.S. PATENT DOCUMENTS

| | | | | |
|---|---|---|---|---|
| 4,492,254 A | * | 1/1985 | Steiner | 139/11 |
| 4,587,996 A | * | 5/1986 | Steiner | 139/194 |
| 4,615,256 A | * | 10/1986 | Fukuta et al. | 87/33 |
| 4,782,864 A | | 11/1988 | Abildskov | |
| RE33,418 E | | 11/1990 | Krueger | |

(Continued)

FOREIGN PATENT DOCUMENTS

| | | |
|---|---|---|
| JP | 8134747 | 5/1996 |

OTHER PUBLICATIONS

S. Wilson et al., "SPARC" 5 Axis, 3D Woven, Low Crimp Preforms, 43rd International SAMPE Symposium and Exhibition May 31–Jun. 4, 1998, published in Resin Transfer Molding, Society for the Advancement of Material and Process Engineering Monograph No. 3, at pp. 101–113 (May 1999).

S. Clarke, "Engineered Textile Preforms for RTM: A Comparison of Braiding, Knitting, and Weaving Technologies," 29th International SAMPE Technical Conference Oct. 28–Nov. 1, 1997, published in Resin Transfer Molding, Society for the Advancement of Material and Process Engineering Monograph No. 3, at pp. 15–23 (May 1999).

H. Kipp, Narrow Fabric Weaving, pp. 221–227 (1989).

*Primary Examiner*—John J. Calvert
*Assistant Examiner*—Robert H. Muromoto, Jr.
(74) *Attorney, Agent, or Firm*—Stradley Ronon Stevens & Young, LLP

(57) ABSTRACT

A loom for weaving three dimensional woven structures which include interwoven bias fibers and at least one integrally woven junction. The loom includes bias fiber holders, bias shuttles, and independently controllable bias arms to interweave the bias fibers. Each bias fiber holder holds a bias fiber under tension. The bias shuttles may releasably grip a number of the bias fiber holders and translate them horizontally between a plurality of predetermined horizontal positions. Each bias shuttle is at a separate vertical position. At least one bias shuttle translates above the shed and at least one bias shuttle translates below the shed. Each independently controllable bias arm may releasably grip one of the bias fiber holders and translate it vertically, at one of the predetermined horizontal positions, with a range of motion extending at least between two of the bias shuttles.

16 Claims, 16 Drawing Sheets

U.S. PATENT DOCUMENTS 5,085,252 A * 2/1992 Mohamed et al. ..... 139/22
5,137,058 A 8/1992 Anahara et al.
5,327,621 A * 7/1994 Yasui et al. ..... 28/149
5,347,743 A * 9/1994 Tokuda et al. ..... 43/24
5,375,627 A 12/1994 Iida et al.
5,394,906 A 3/1995 Farley
5,399,418 A 3/1995 Hartmanns et al.
5,431,193 A 7/1995 Mood et al.
5,435,352 A 7/1995 Yamamoto et al.
5,451,448 A 9/1995 Sawko et al.
5,465,760 A 11/1995 Mohamed et al.
5,657,795 A 8/1997 Sawko et al.
5,775,381 A 7/1998 Addis
5,783,278 A * 7/1998 Nishimura et al. ..... 428/102
5,783,279 A 7/1998 Edgson et al.
5,981,022 A 11/1999 Min et al.
6,019,138 A * 2/2000 Malek et al. ..... 139/1 R
6,129,122 A 10/2000 Bilisik
6,152,187 A * 11/2000 Lindblom ..... 139/11
6,283,168 B1 * 9/2001 Gu et al. ..... 139/384 R
6,418,973 B1 * 7/2002 Cox et al. ..... 139/383 R
6,742,547 B2 * 6/2004 Bryn et al. ..... 139/383 R

* cited by examiner

LOOM AND METHOD OF WEAVING THREE-DIMENSIONAL WOVEN FORMS WITH INTEGRAL BIAS FIBERS

CROSS REFERENCE TO RELATED APPLICATIONS

This application is a divisional of U.S. patent application Ser. No. 09/956,641, filed Sep. 20, 2001 now U.S. Pat. No. 6,742,547, which claims the benefit of priority of U.S. Provisional Application No. 60/234,036, filed on Sep. 20, 2000.

TECHNICAL FIELD

The present invention relates generally to loom designs and, more particularly, to a fully automated loom design capable of weaving pre-form shapes such as "T," "Pi," and truss-core.

BACKGROUND OF THE INVENTION

Composite materials are those materials that result when two or more materials, each having its own (usually different) characteristics, are combined to yield useful properties for specific applications. In many applications, composite materials outperform more traditional solid materials such as wood, metal, and plastic. Therefore, great interest exists in the design of strong, lightweight structures formed using composite materials.

The advanced composite industry has commensurately shown increasing interest in cost-effective processes that yield high-quality composite parts. Among these processes is resin transfer molding (RTM). Traditionally, composite part fabrication has used very little textile technology. The manufacture of all textile product forms starts with raw fiber. Discrete fiber lengths (staple fiber) can be processed into random or semi-oriented mats (non-wovens). The raw fibers can be twisted together to form a spun yarn. Continuous filament yarns are also available. Three main drawbacks plague implementation of pre-form technology for advanced composite RTM markets: (1) meeting performance requirements for engineered structures, (2) satisfying shape requirements for complex parts, and (3) reducing manufacturing costs. Current developments of textile pre-form techniques suitable for RTM attempt to overcome these drawbacks.

Typically, simple, two-dimensional (2D) woven fabrics or unidirectional fibers are produced by a material supplier and sent to a customer who cuts out patterns and lays up the final part ply-by-ply. Recently, the industry has sought to use the potential processing capabilities and economics associated with textiles to produce near-net-shape fiber assemblies or pre-forms. If designed and implemented correctly, engineered textile pre-forms with controlled fiber architecture can potentially offer a structurally efficient and cost effective fabrication of composites having various shapes and meeting stringent performance requirements.

One method of forming desired composite structures is to create matrices of extremely strong fibers which are then locked in a hardening resin. Carbon fiber, glass fibers, aramid fiber, silicon carbide fiber, and various ceramics have all been used in such materials. The resin, often an epoxy, forms the shape of the structure and holds the fibers together upon hardening, while the fibers provide exceptional tensile strength along the axes of the fibers. Composite materials may also be designed to allow flexibility perpendicular to the axes of the fibers with greatly reduced issues of fatigue from repeated cycling.

Numerous methods can be used to create the desired fiber matrix forms for such structures. Such methods include weaving, knitting, braiding, twisting, and matting. Each of these methods has both advantages and limitations. Matting is the simplest of these methods, but has as limitations that the fibers are mostly only held together by the resin, which may lead to de-lamination, and that the number of fibers pointing in a particular direction, and hence the tensile strength in that direction, is not easily controlled. Braiding and twisting are limited to substantially linear structures. Knitting forms a substantially flat structure in which most fibers are not straight. Therefore, tensile stresses will work to straighten the fibers and a composite material having a matrix of knitted fibers as a pre-form will tend to stretch to some degree. Depending on the application, this characteristic may be desirable—but it is often undesirable. A woven material will hold together and resist stretching along fiber axes, even before the addition of the resin.

The simplest woven materials are flat, substantially 2D structures with fibers in only two directions. They are formed by interlacing two sets of yarns perpendicular to each other. In 2D weaving, the 0° yarns are called the warp and the 90° yarns are called the weft, weave, or fill. Fabrics with 0° yarns and 90° yarns are produced in at least four ways. First, the number of yarns per inch may be varied in either the warp or fill direction. Second, the weaver may use a yarn with a smaller or larger filament count, which changes the weight per unit area. Third, the weaver may adjust the number of harnesses used, ranging from two (for a plain weave) to more than twenty. Each harness contains a number of heddles, or healds, loops connected to the warp yarns which move warp yarns up and down, opening and closing the shed of the loom. Fourth, the fabric can contain a mixture of fabric types in either direction. For RTM, a series of woven fabrics can be combined to form a dry layup, which is placed in a mold and injected with resin. These fabrics can be pre-formed using either a "cut and sew" technique or thermally formed and "tacked" using a resin binder.

2D woven structures have limitations. The step of pre-forming requires extensive manual labor in the layup. 2D woven structures are not as strong or stretch-resistant along other than the 0° and 90° axes, particularly at angles farther from the fiber axes. One method to reduce this possible limitation is to add bias fibers to the weave, fibers woven to cut across the fabric at an intermediate angle, preferably at +45° and −45° to the axis of the fill fibers.

Simple woven forms are also single layered. This limits the possible strength of the material. One possible solution is to increase the fiber size. Another is to use multiple layers, or plies. An additional advantage of using multiple layers is that some layers may be oriented such that the warp and weave axes of different layers are in different directions, thereby acting like the previously discussed bias fibers. If these layers are a stack of single layers laminated together with the resin, however, then the problem of de-lamination arises. If the layers are sewn together, then many of the woven fibers may be damaged during the sewing process and the overall tensile strength may suffer. In addition, for both lamination and sewing of multiple plies, a hand layup operation usually is necessary to align the layers. Alternatively, the layers may be interwoven as part of the weaving process. Creating multiple interwoven layers of fabric, particularly with integral bias fibers, has been a difficult problem. Some exemplary methods to accomplish the production of a fabric having multiple interwoven layers with bias fibers are disclosed in U.S. Pat. No. 5,540,260 issued to Mood and titled "Multi-Axial Yard Structure and Weaving Method."

Fabrics woven by these previously described methods are still substantially 2D structures. Such fabrics are very useful for structures, such as an "L" shaped form, which do not have any junctions at which three or more sections meet. If structures having cross-sectional shapes such as "T," "Pi," and truss-core are formed from a substantially 2D fabric, however, then junctions must be formed either by lamination or sewing with the same flaws previously described.

Three-dimensional (3D) weaving is capable of creating fully integrated shapes with high laminar strength. Shapes such as "T," "Pi," and truss-core are possible without lamination or sewing. On the other hand, relative to 2D weaving, 3D weaving is more expensive and slower.

Jacquard control is one method of forming 3D woven forms. A Jacquard-control system allows individual heddles to be raised and lowered in any combination, rather than only a preset number of combinations determined by the harnesses in the loom. FIG. 10 shows a series of individual heddles 1000, holding warp yarns 102. Each of these exemplary heddles 1000 employs a hook 1002 with a clasp 1003 to hold the yarns 102. Specific heddle 1004 is shown in a raised position forming a shed.

The usefulness of this capability to individually control the heddles is demonstrated in FIGS. 9A–9E. Traditionally, heddle selection is programmed on a punched Jacquard-card which is fed through a reading mechanism on a loop, but this may also be accomplished via other digital or analog programming techniques. FIG. 9A illustrates a simple 3D form, a "T." A single fill fiber 900 may be woven through warp fibers 902, 904, 906, 908, 910, 912, and 914 in four steps, as shown in FIGS. 9B–9E. This is only one of the possible operations to accomplish this particular weave pattern and only one of the possible weave patterns which may be used to create a "T" form.

FIG. 9B shows the fill fiber 900 being passed from left to right through a shed formed by raising warp fibers 904 and 908, while lowering the remaining warp fibers 902, 906, 910, 912, and 914. Next, as shown in FIG. 9C, warp fiber 908 is lowered and warp fibers 902, 906, and 910 are raised, then the fill fiber 900 is passed back to the left. In FIG. 9D, warp fibers 912 and 908 are raised and fill fiber 900 again passes through the shed to the right. Finally, FIG. 9E shows warp fiber 914 being raised and warp fibers 904 and 912 being lowered as fill fiber 900 returns to the left.

This weave could be accomplished using an eight-harness system as well as a Jacquard-control system. As 3D forms become more complex, however, this alternative becomes impractical. In addition, reprogramming a Jacquard system is much simpler and less time consuming than changing, and possibly reprogramming the motion of, a set of harnesses.

To overcome the shortcomings of existing weaving technology as applied to form three dimensional structures with integrally interwoven junctions and integrally interwoven bias fibers, a new weaving loom is provided. An object of the present invention is to provide improved three dimensional woven forms for RTM composite material processing. A related object is to simplify the RTM processing procedure. Another object is to simplify the addition of integrally interwoven bias fibers in woven structures.

SUMMARY OF THE INVENTION

To achieve these and other objects, and in view of its purposes, the present invention provides an improved weaving loom. The loom permits the formation of cross-sectional shapes with integrally interwoven junctions as a single piece. Jacquard-controlled heddles are used to orchestrate a complicated series of motions of the warp fibers. Previously, no loom existed which combined the 3D cross-section capabilities of a Jacquard-control system with interwoven bias fibers.

One embodiment of the present invention is a loom for weaving 3D structures which include a plurality of warp fibers, a fill fiber, and a plurality of interwoven bias fibers. An exemplary loom includes a plurality of heddles, a plurality of bias fiber holders, a plurality of bias shuttles, a plurality of independently controllable bias arms, a weave shuttle, and a reed. The heddles are adapted to translate the warp fibers vertically. Each heddle is designed to independently move one of the warp fibers between an upper warp position and a lower warp position. The motion of the heddles causes the warp fibers to form a shed.

The bias fibers are held by the bias fiber holders. Each bias fiber holder is adapted to hold a bias fiber under tension. The bias fiber holders may be releasably gripped in either (a) one of a plurality of bias shuttles, or (b) one of a plurality of independently controllable bias arms.

The bias shuttles are adapted to releasably grip a number of bias fiber holders. Each bias shuttle has a separate vertical position and can translate horizontally carrying gripped bias fiber holders between a plurality of predetermined horizontal positions. At least one bias shuttle is configured in a vertical position above the shed and at least one bias shuttle is configured in a vertical position below the shed.

Each bias arm is adapted to releasably grip one bias fiber holder at a time and is located at one of the predetermined horizontal positions. Each bias arm has a range of motion which extends, at least, between two of the bias shuttles. Each bias arm may translate a gripped bias fiber holder within its range of motion.

The weave shuttle is adapted to pass the fill fiber through the shed formed by the warp fibers and the bias fibers, substantially along a centerline of the shed. The weave shuttle may also be a needle. The reed is used for beat up.

In another aspect of the present invention, a 3D woven structure is provided with bias fibers. An exemplary 3D woven structure with bias fibers includes a first woven planar fabric piece, a second woven planar fabric piece, and an integrally woven junction. The first woven planar fabric piece has a central portion and two selvedges and is woven from a plurality of first warp fibers, a fill fiber, and a plurality of bias fibers. The second woven planar fabric piece is formed from a plurality of second warp fibers (which are distinct from the first warp fibers), the fill fiber, and a subset of the bias fibers. The integrally woven junction couples the central portion of the first woven planar fabric piece to the second woven planar fabric piece.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The entire disclosure of U.S. patent application Ser. No. 09/956,641, Sep. 20, 2001, is expressly incorporated by reference herein.

An exemplary embodiment of the present invention is a loom that automatically inter-weaves bias-plied, 3D, woven pre-forms into complex configurations such as "Pi" and "T" shapes. This is in contrast to methods such as stitching mechanisms designed to sew together 2D layers of bias plies or manual hand-layup of bias plies to form 3D structures. This exemplary embodiment offers several advantages over the known art, including:

1. The elimination of a stitching mechanism reduces fiber damage within the woven pre-form, achieves higher damage tolerance, and tolerates higher tension and shear loads for composite materials. Further, the elimination of a stitching mechanism reduces fabricating costs by avoiding the stitching process.

2. The elimination of a hand-layup process reduces possible de-lamination failure of the composite structure, achieves higher damage tolerance, permits weight reduction of the composite structures, tolerates higher tension and shear loads for composite materials, and reduces fabricating costs.

Figure 1:
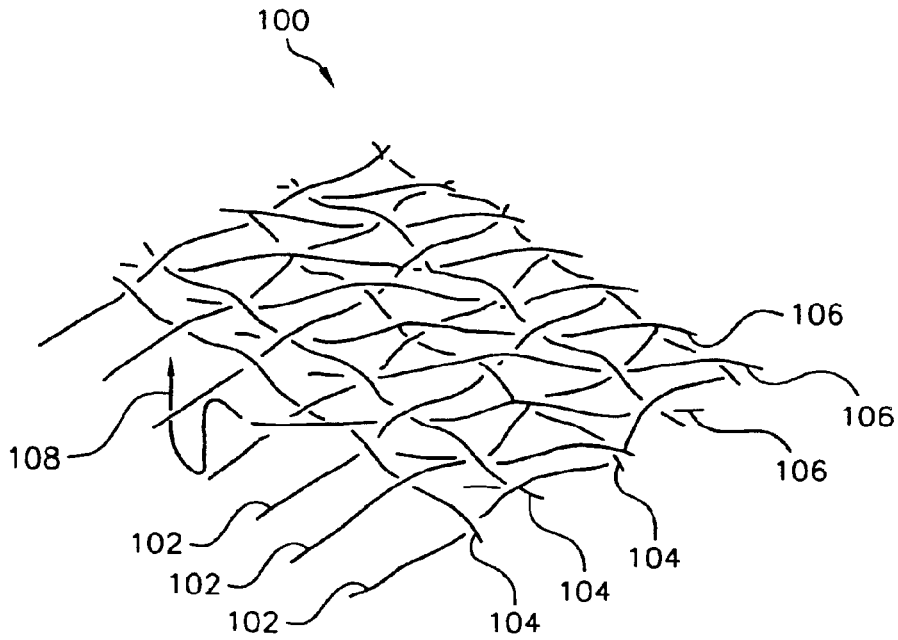
FIG. 1 is a perspective drawing illustrating a piece of fabric which includes a 45° bias fiber.
Figure 2:
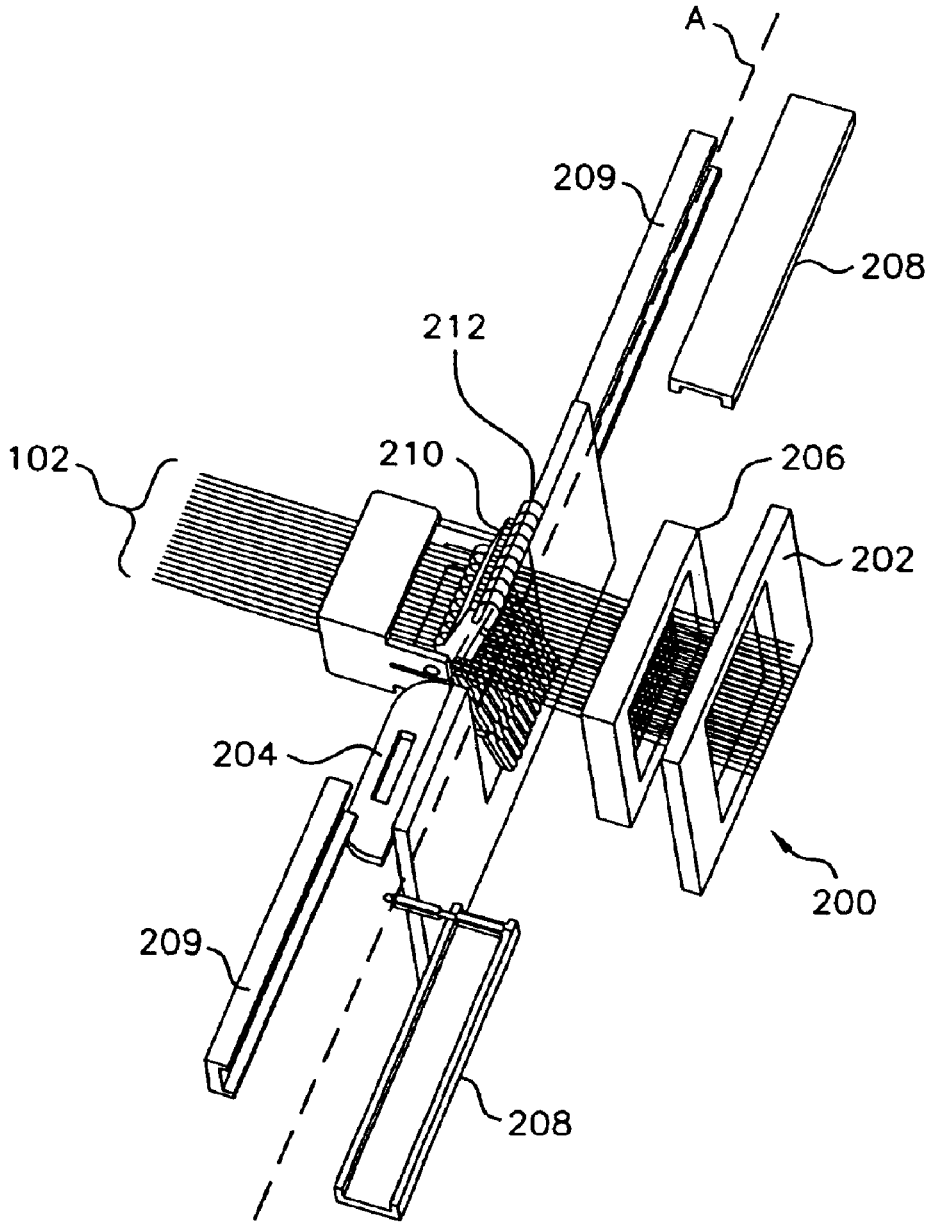
FIG. 2 is a perspective drawing of an exemplary loom for weaving 3D forms including bias fibers.

Referring now to the drawing, in which like reference numbers refer to like elements throughout, FIGS. 1 and 2 facilitate a description of the bias plies weaving loom of the present invention. FIG. 1 shows a flat fabric piece 100 with warp fibers 102, fill fibers 104, and +45° bias fibers 106. In order to interweave the +45° bias fibers 106 with the warp fibers 102 and the fill fibers 104, each of the ends of the +45° bias fibers 106 must be maneuvered as indicated by direction arrow 108. The +45° bias fiber 106 is offset one warp spacing in the fill direction by passing alternatively above and below adjacent warp fibers 102. For true weaving, this bias filling motion must occur between weaving steps. Moreover, in order to weave complex shapes with both +45° and −45° bias fibers, the bias filling motion must occur in both directions from above and below the weave and be fully programmable (using the capabilities and advantages of computer technology and automation).

As shown in FIG. 2, an exemplary bias weaving loom 200 of the present invention has many of the same elements as a conventional loom: a set of heddles (only the heddle frame 202 is shown in the figures to reduce clutter and improve clarity); a weave shuttle 204; and a reed 206. The exemplary loom 200 also includes a number of bias shuttles 208 and 209, an array of bias arms 210, and a number of bias fiber holders 212. The bias shuttles preferably include two horizontal bias shuttles 208 and two vertical bias shuttles 209 as shown in FIG. 2.

The heddles are designed to controllably open and close the warp fibers 102, creating a shed 404 (see FIG. 4B and the discussion below) for the shuttles (weave shuttle 204 and bias shuttles 208, 209) to pass through. The heddles are independently controllable, preferably using a Jacquard-control mechanism, allowing complex 3D forms to be created in the loom 200. This mechanism also allows for the creation of interwoven multi-layer fabrics.

The captured weave shuttle 204 inserts the fill fiber 104 through the shed 404, and the reed 206 performs beat-up operations to maintain the desired fill spacing. The +45° bias fibers 106 are introduced into the weave via the bias fiber holders 212, which are adapted to be maneuvered through the weave horizontally by the bias shuttles 208, 209 and vertically by the array of bias arms 210. The designations of horizontal and vertical, and the later designations of upper and lower, are used only for convenience and do not correspond to limitations on the orientation of the present embodiment. The bias arms 210 are hinged to allow the fibers to move above and below the weave axis "A" and, preferably, outside of the shed 404.

FIG. 2 shows the preferred embodiment in which the bias arms 210 are separated into two sets, one set operating to translate the +45° bias fibers 106 from above the upper side of the shed 404 to the weave axis and the other set operating to translate the +45° bias fibers 106 from the weave axis to below the lower side of the shed 404. The array of bias arms 210 is shown located above and below the weave in FIG. 2. Each arm 210 pivots about a line close to the fill line. Thus, the arms 210 are capable of moving the tubes 304 (see FIG. 3 and the discussion below) in and out of the warp fibers 102 while holding nearly constant the distance from the fiber end to the weave axis. Much like a Jacquard head, an arbitrary sequence of arm moves can be programmed: the arms 210 can be moved in concert or singly in order to selectively weave +45° bias fibers 106.

Some weave sequences require that the +45° bias fibers 106 be passed completely through the thickness of the weave. This operation is readily completed by passing a tube from an arm above the weave to an arm below the weave. This operation is shown in more detail in FIGS. 6A–6C.

Figure 3:
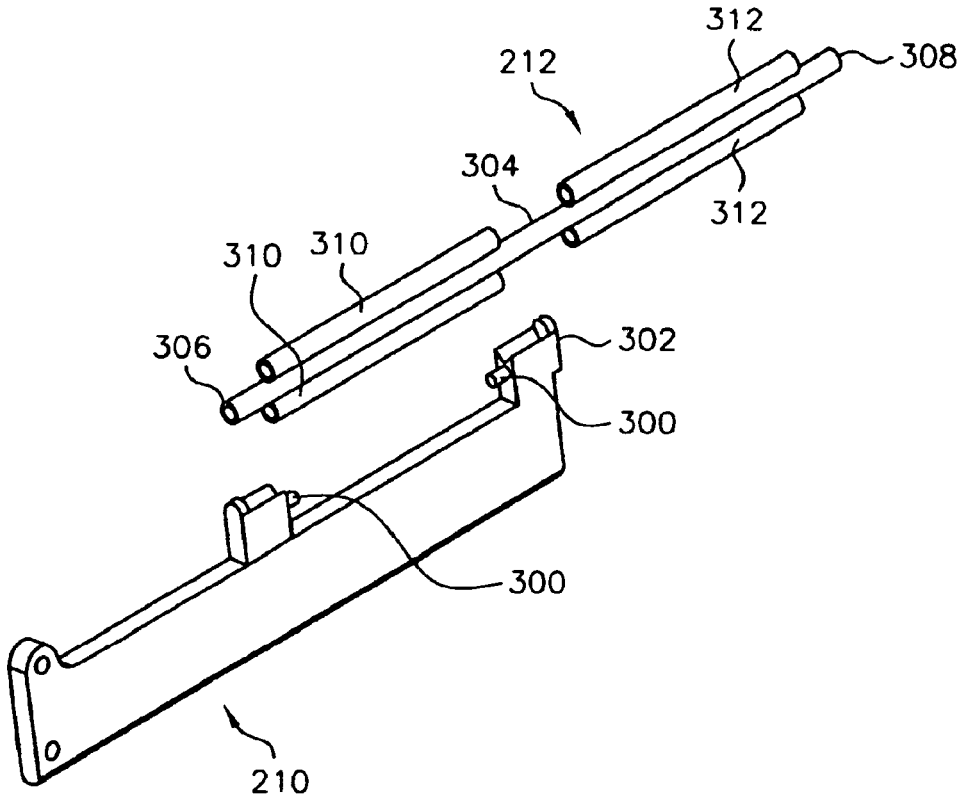
FIG. 3 is a perspective drawing of an exemplary bias fiber arm and bias fiber holder.

FIG. 3 is a more detailed illustration of the bias fiber holder 212 and a bias fiber arm 210, which are used to handle and tension the +45° bias fibers 106. Because the +45° bias fibers 106 are relatively short, they may be cut to length before introduction into the weave. The +45° bias fibers 106 are maneuvered in and around the weave by carrying them in tubes 304. Each tube 304 is preferably slightly longer than the longest +45° bias fiber 106. The tube 304 has a vacuum port 308 at one end and a ceramic lining 306 at the other end. A length of +45° bias fiber 106 is loaded into the tube 304 at the ceramic-lined end and drawn into the tube 304 by applying a vacuum to the vacuum port 308. The flow of air between the +45° bias fiber 106 and the ceramic lining 306 at the front of the tube 304 creates a nearly constant tension on the +45° bias fiber 106. The vacuum is preferably supplied by connection of the vacuum port 308 to the bias shuttles 208, 209.

Small lengths of tubing are brazed onto the tube 304 in order to provide gripper interfaces. There are preferably two arm gripper interfaces 310 and two shuttle gripper interfaces 312, as shown in FIG. 3. This configuration allows a bias fiber holder 212 to be simultaneously gripped by a bias arm 210 and a bias shuttle 208 or 209, or by two bias arms 210, to accommodate transfers. A typical gripper (comprising two arm gripper interfaces 310 and two shuttle gripper interfaces 312) on a bias arm 210 is shown in FIG. 3. Opposing pins 300 engage one of the arm gripper interfaces 310 and pull the tube 304 against the spring-loaded V-grooves 302 to precisely locate the tube 304.

As shown in FIG. 1, the weaving of the +45° bias fibers 106 requires not only that they be brought above and below the weave, but also that they be offset across the warp fibers 102. The bias shuttles 208, 209 can grip an array of bias fiber holders 212 and carry out this motion while tensioning the fiber by drawing a vacuum through the tube ends. Each bias shuttle 208, 209 includes an array of grippers to grip bias fiber holders 212. Each bias shuttle 208, 209 is also adapted, preferably using computer control, to move horizontally in the fill (90°) direction by increments of the warp fiber spacing. The vertical bias shuttles 209 also may serve as buffers during many weave sequences. This service allows the bias arms 210 to pass those bias fiber holders 212 not involved in a particular weave sequence to the vertical bias shuttles 209 and receive new bias fiber holders 212 from opposing bias arms 210 or vertical bias shuttles 209.

FIGS. 4A through 4H illustrate an exemplary weaving loom sequence using the loom 200 of the present embodiment. At the beginning of this sequence, illustrated in FIG. 4A, a fiber has been cut to length and inserted into the individual bias fiber holder 400 with a small length of fiber extending beyond the ceramic-lined end of the newly filled individual bias fiber holder 400. The newly filled individual bias fiber holder 400 is mounted on the right horizontal bias shuttle 401. The bias fiber holders 212 gripped by the array of bias arm 210 above and below the warp carry fibers whose ends are already engaged into the weave. The warp is beginning to open the shed 404 in preparation for the insertion of a weave (90°) fiber by weave shuttle 204.

Figure 4A:
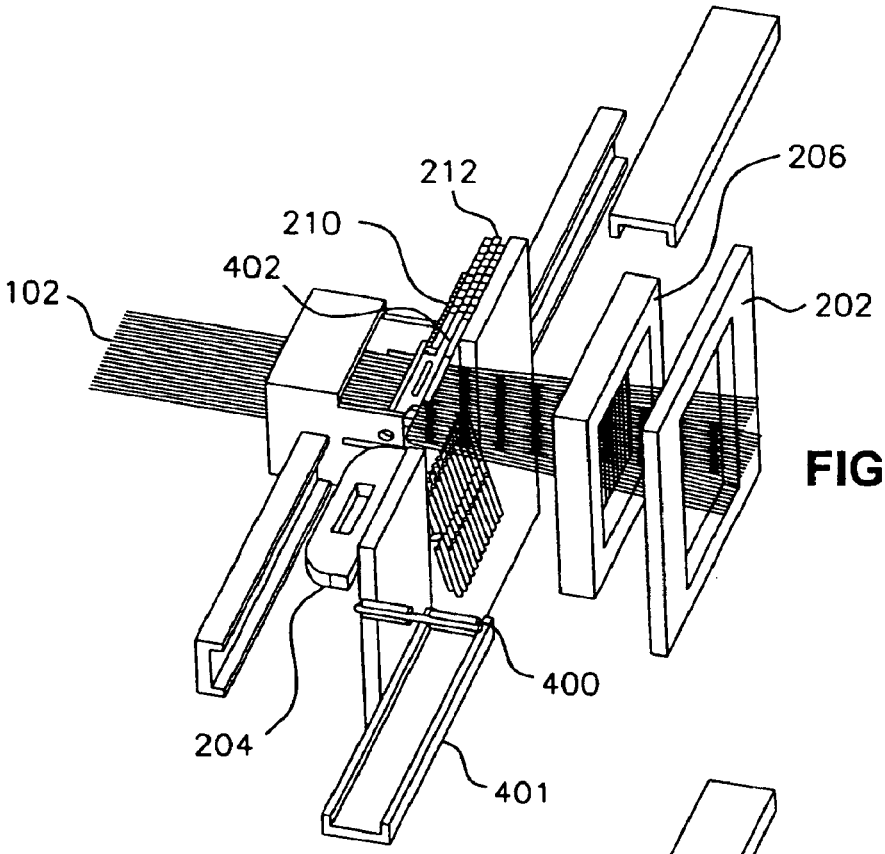
FIGS. 4A–4H are a sequence of perspective drawings of the exemplary loom in FIG. 2 illustrating an exemplary operation of the bias fiber arms, bias fiber holders, and a bias fiber shuttle.
Figure 4B:
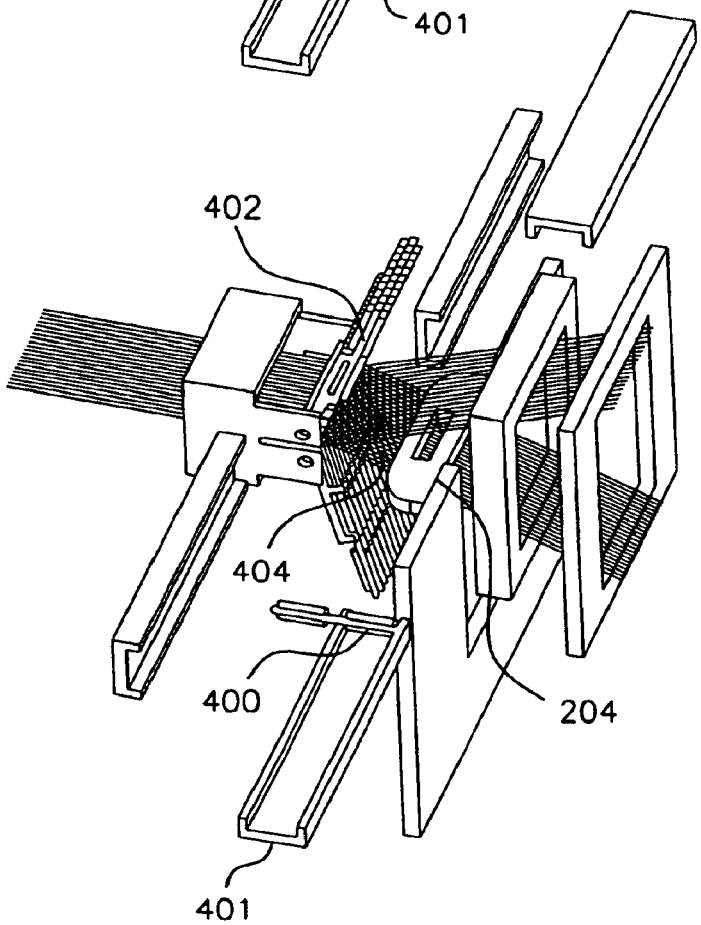
Figure 4C:
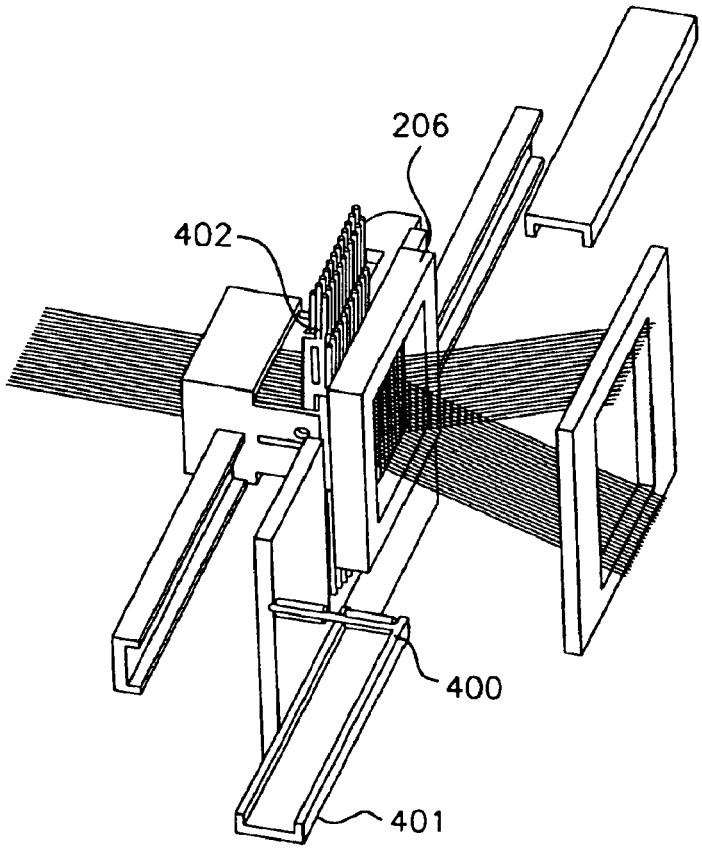
Figure 4D:
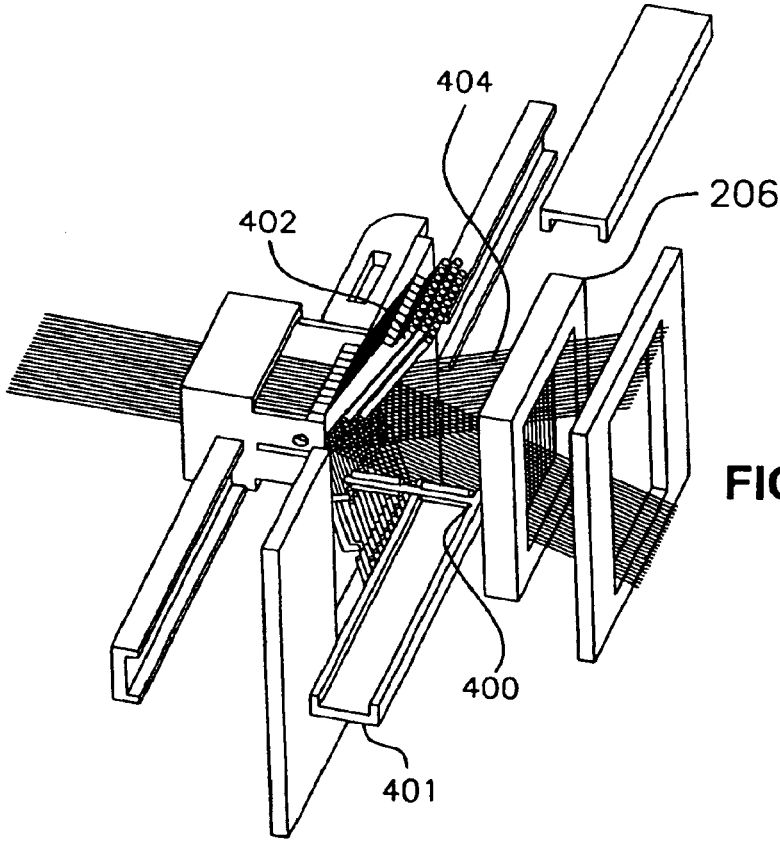

FIG. 4B illustrates the next step in this sequence. The warp is completely opened forming the shed 404 as the weave shuttle 204 passes through. The weave shuttle 204 pulls behind it a fill fiber 104. As illustrated in FIG. 4C, once the weave shuttle 204 has passed completely through the warp, the reed 206 comes forward for beat up. FIG. 4D shows the right horizontal bias shuttle 401 carrying a newly filled individual bias fiber holder 400. The right horizontal bias shuttle 401 moves through the shed 404 of the open warp as the top array of bias arms 210 lowers the bias fiber holders 212 between warp fibers.

Figure 4E:
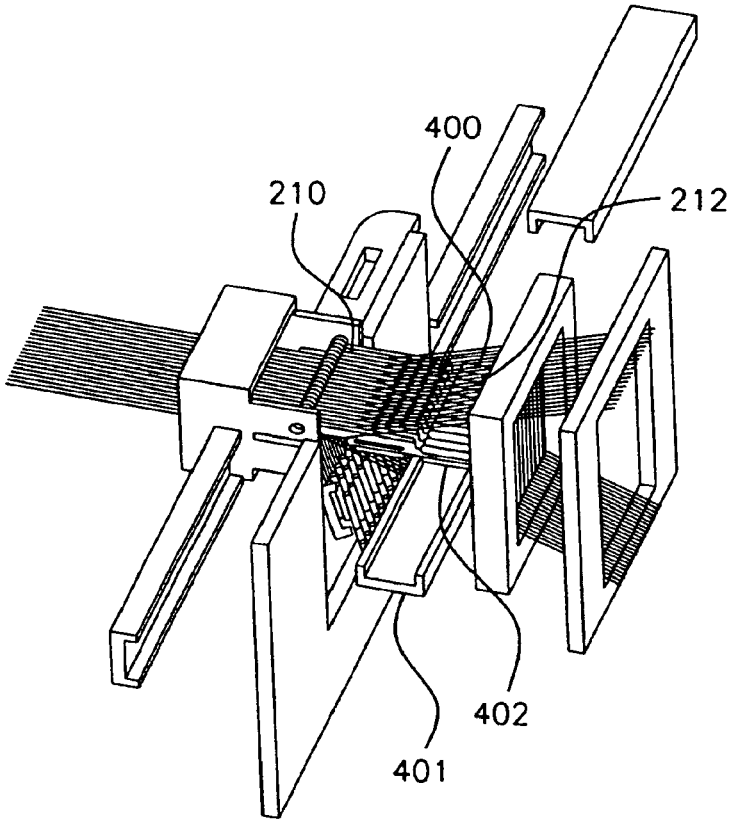

FIG. 4E illustrates the next step in this exemplary sequence. Right horizontal bias shuttle 401 has passed newly filled individual bias fiber holder 400 completely through the shed 404 so that one tube-spacing exists beyond the farthest warp fiber. The loom 200 grips a small length of +45° bias fiber 106 extending beyond the ceramic lined end of the individual bias fiber holder 400 so that it will be pulled out of the individual bias fiber holder 400 and into the weave during subsequent movement of the individual bias fiber holder 400. The top bias arms 210 deposit each of the bias fiber holders 212, including the nearly empty individual bias fiber holder 402, onto the right horizontal bias shuttle 401.

Figure 4F:
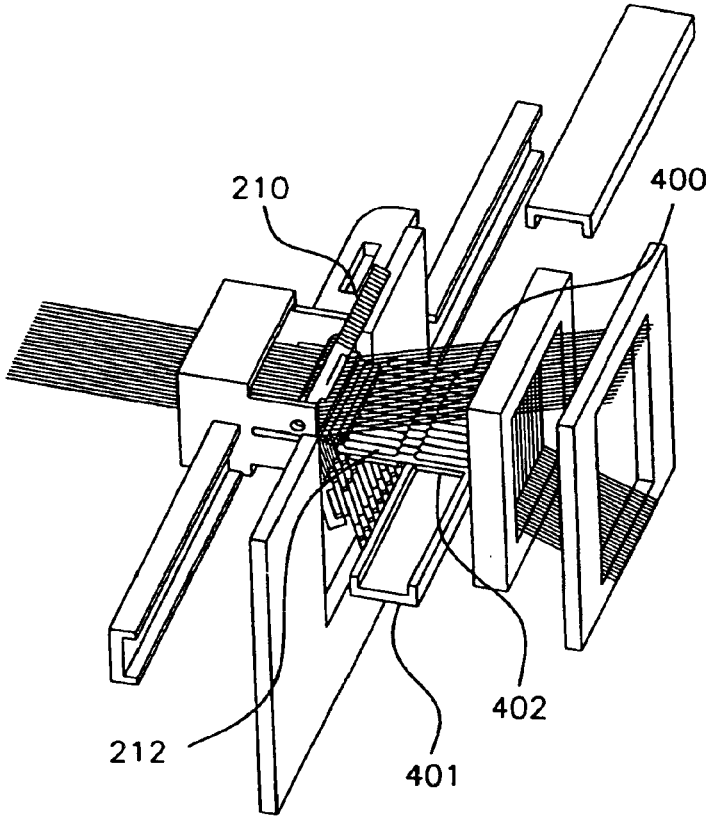

In FIG. 4F, the top array of bias arms 210 release bias fiber holders 212 and nearly empty individual bias fiber holder 402 and rise above the warp. The right horizontal bias shuttle 401 indexes to the right by one warp fiber spacing. This motion pulls the +45° bias fibers 106 under the warp fibers 102 in the process of weaving the +45° bias fibers 106. Motion of other bias fiber holders 212 in the opposite direction, as orchestrated by the bias arms 210 and bias shuttles 208, 209, may allow for simultaneous weaving of the −45° bias fibers.

Figure 4G:
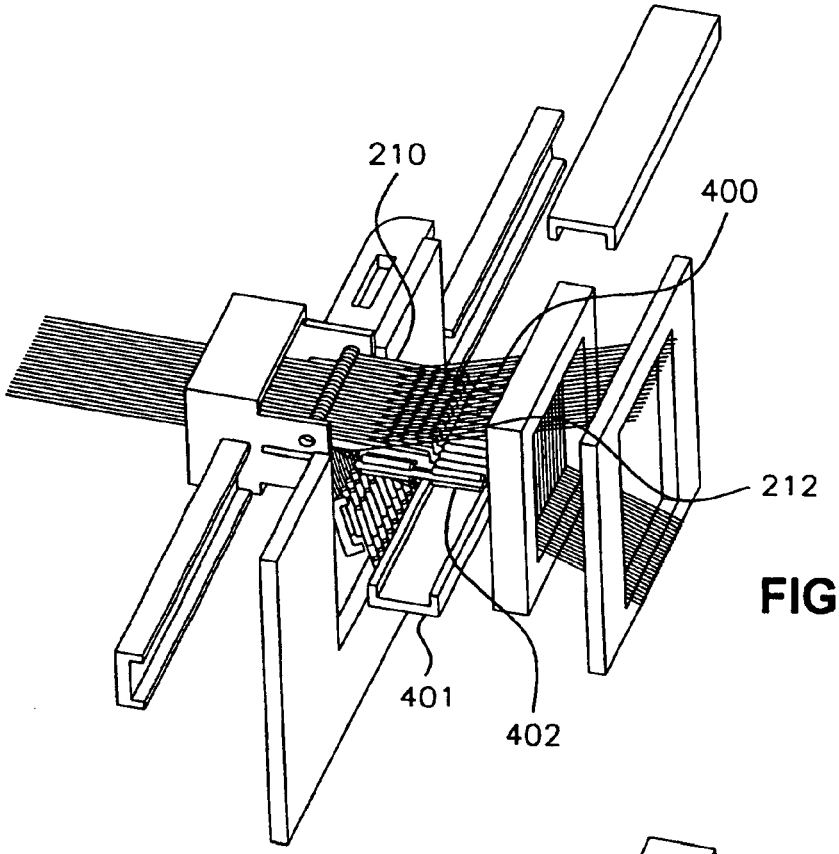
Figure 4H:
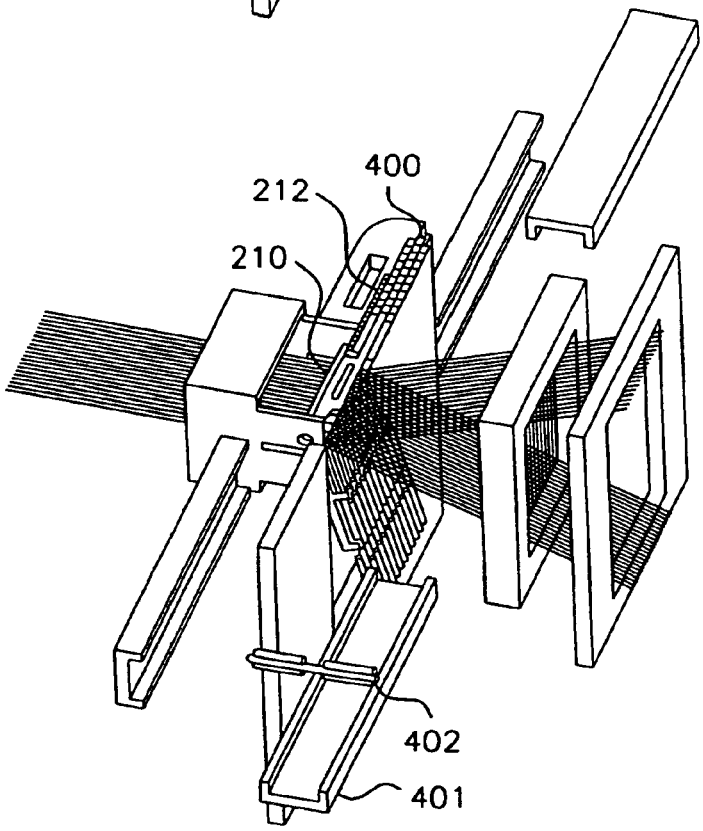

FIG. 4G illustrates the next step: the top bias arms 210 again come down between the warp fibers 102 and grip all but the nearly empty individual bias fiber holder 402, which is the right-most fiber holder. Finally, in the last step of the first sequence, as shown in FIG. 4H, the top bias arms 210 again rise, carrying with them each of the bias fiber holders 212 carrying fibers engaged in the weave. Nearly empty individual bias fiber holder 402 is withdrawn with right horizontal bias shuttle 401 to be reloaded by the loading module (not shown).

It is contemplated that this operation may be performed using more than one newly filled individual bias fiber holder 400 at a time and that the horizontal bias shuttle 208 may be indexed any whole number of warp fiber spacings to allow for bias fibers at angles other than ±45°.

Figure 5A:
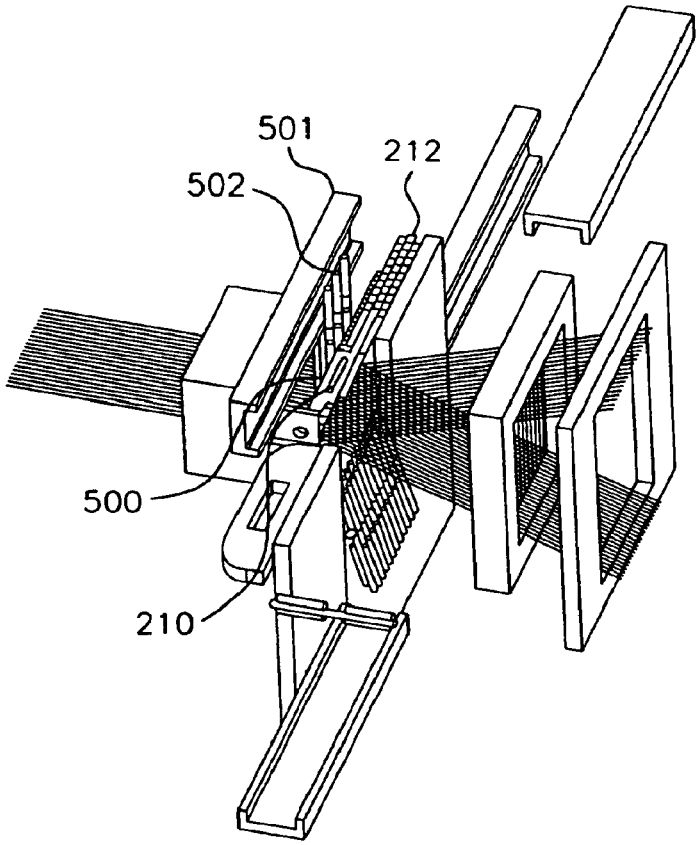
FIGS. 5A–5C are a sequence of perspective drawings of the exemplary loom in FIG. 2 illustrating another exemplary operation of the bias fiber arms, bias fiber holders, and a bias fiber shuttle.
Figure 5B:
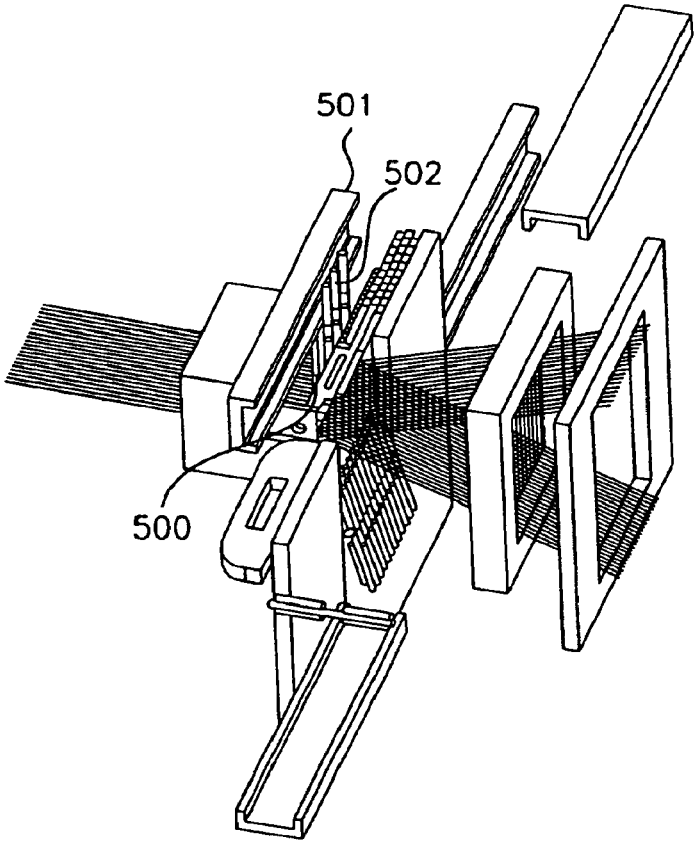
Figure 5C:
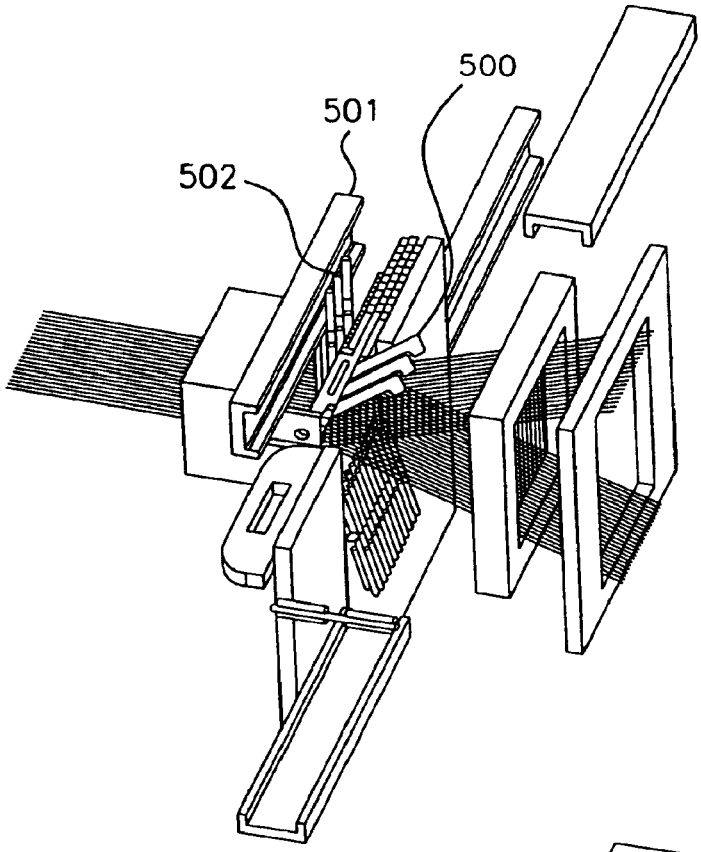

FIGS. 5A through 5C illustrate a second exemplary weaving loom sequence. In this exemplary sequence, as shown in FIG. 5A, three of the bias arms 500, carrying three bias fiber holders 502, move upward from their starting position as upper bias shuttle 501 moves to the left. The three bias fiber holders 502 are gripped by the upper bias shuttle 501 and released by the bias arms 500.

FIG. 5B shows how the upper bias shuttle 501, which now holds the three bias fiber holders 502, may be indexed to the right by a single warp fiber spacing. This indexing function may, instead, move the upper bias shuttle 501 a single warp fiber spacing to the left or another number of warp fiber spacings in either direction as necessary to clear the bias fiber holders 502 from the bias arms 500. Finally, as shown in FIG. 5C, the empty bias arms 500 move down, ready to receive bias fiber holders 502 from bias shuttles or the opposing bias arms, and bias fiber holders 502 remain buffered in upper bias shuttle 501.

The number of bias fiber holders 502 being buffered in upper bias shuttle 501 in FIGS. 5A–5C was chosen to be three for exemplary purposes only. This number may range from one to the total number of bias fiber holders 502 being employed in the loom 200, depending on the actual 3D fabric form being woven.

Figure 6A:
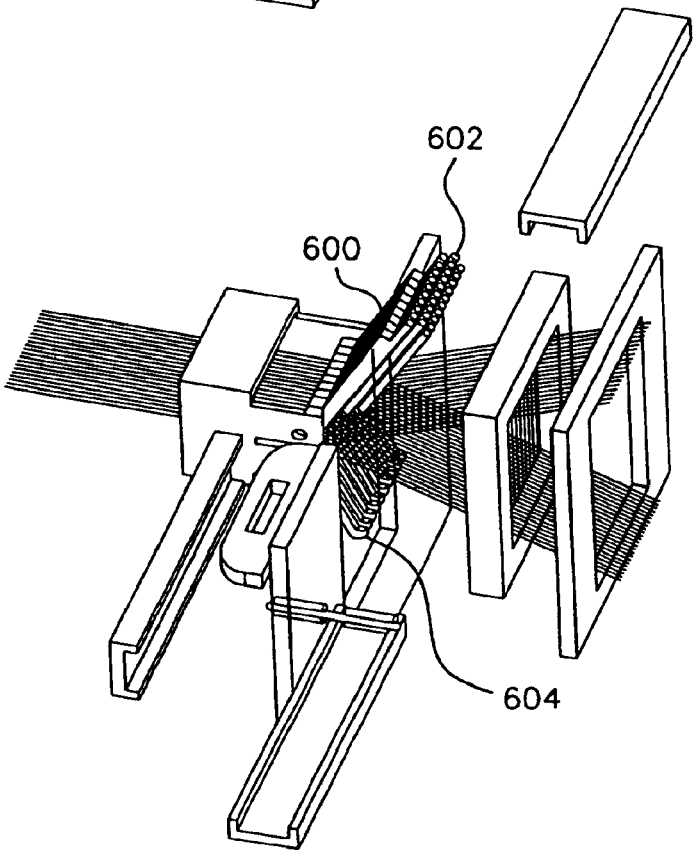
FIGS. 6A–6C are a sequence of perspective drawings of the exemplary loom in FIG. 2 illustrating an exemplary operation of the bias fiber arms and bias fiber holders.
Figure 6B:
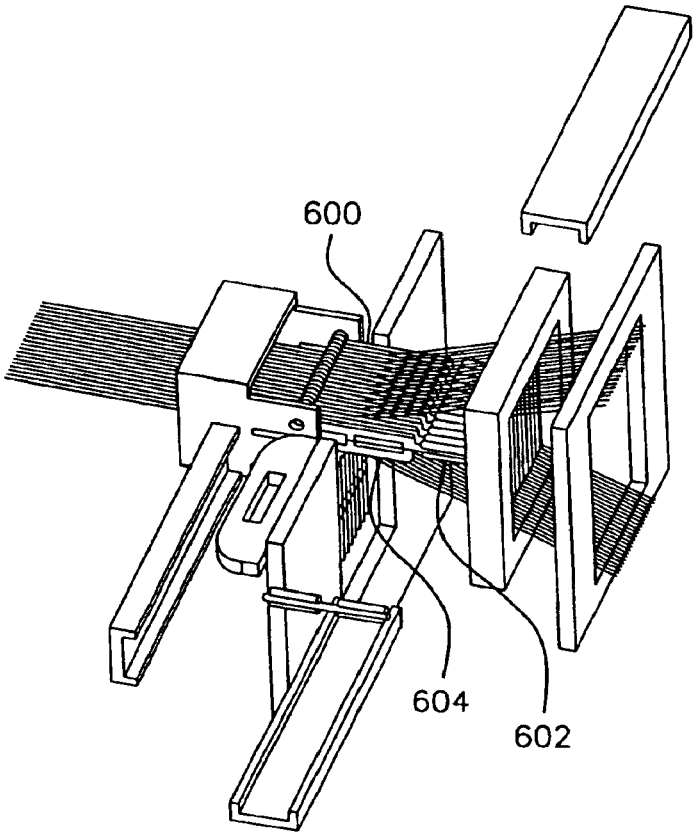
Figure 6C:
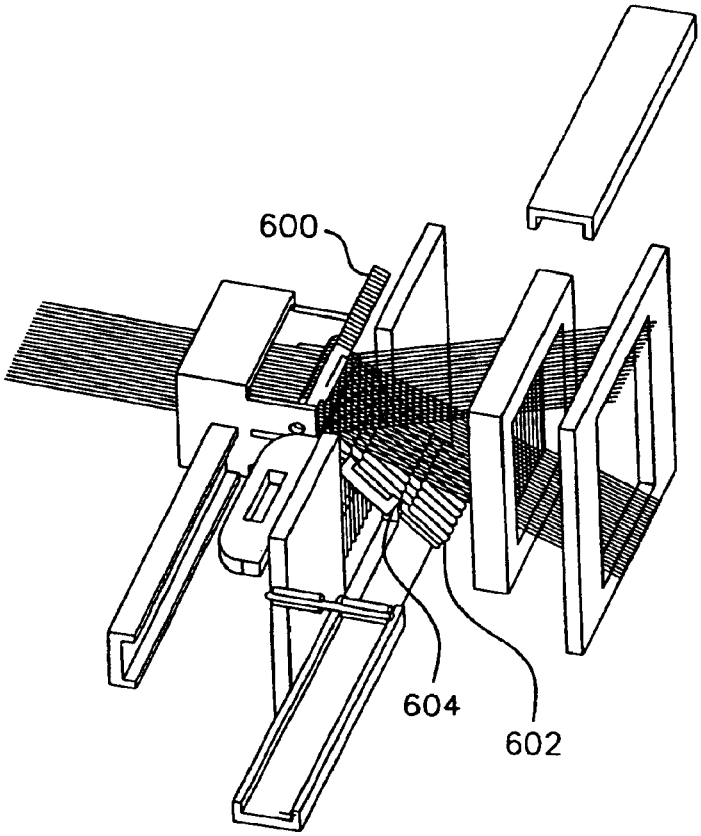

FIGS. 6A through 6C illustrate a third exemplary weaving loom sequence. At the beginning of this sequence, as shown in FIG. 6A, the array of bottom bias arms 604 has deposited its bias fiber holders 602 on the lower bias shuttle (hidden from view). The bias fiber holders 602 are being gripped by the array of top bias arms 600. Both the top and bottom bias arms begin to come through the open warp.

The top bias arms 600 and the bottom bias arms 604 meet in the horizontal plane along the warp axis in the step shown in FIG. 6B. The bias fiber holders 602 are then gripped by the bottom bias arms 604 and released by the top bias arms 600. Finally, as shown in FIG. 6C, the top and bottom bias arms return to their original positions, the bottom bias arms 604 now carrying the bias fiber holders to below the shed 404 formed by the warp fibers 102.

This operation may also be used to transfer the bias fiber holders 602 from the bottom bias arms 604 to the top bias arms 600. In addition, although all bias arms were involved in the exemplary transfer shown in FIGS. 6A–6C, any number of bias fiber holders may be transferred, depending on the actual 3D fabric form being woven.

The three exemplary bias fiber weaving sequences illustrated in FIGS. 4A–4H, FIGS. 5A–5C, and FIGS. 6A–6C utilize the independently controllable bias arms and computer controlled bias shuttles to allow precise, and complex, placement of bias fibers within a woven form. This control of the weave path of the bias fibers is preferably combined with Jacquard-control of the independent heddles to precisely define the weave path of the weave thread among the warp threads and bias threads. In this way, any 3D woven form, which may be formed with warp and fill fibers, no matter the complexity, may be formed to include bias fibers integrally woven throughout the form.

FIGS. 7A–7F and 8 illustrate a number of cross-sectional shapes of 3D woven forms, which may be formed using the exemplary loom 200 described above, as viewed in the direction parallel to the warp fibers 102. These forms include at least one woven layer containing warp fibers 102 and fill fibers 104. Multiple layers, which are preferably interwoven, may also be formed in a specific portion of a form or the entire form. The 3D woven forms may additionally contain bias fibers oriented along one or more angles, preferably +45° and −45°. Each form has a first fabric piece 700 with two selvedges 704 constituting the opposing woven edges of the first fabric piece 700. The selvedges 704 are connected to at least one additional (in the example illustrated in FIG. 7A, a second) fabric piece 702 by a woven junction 706. Although the figures illustrate the exemplary structures as formed with substantially straight fabric portions, this is not necessary; structures including curved portions may be formed as well.

Figure 7A:
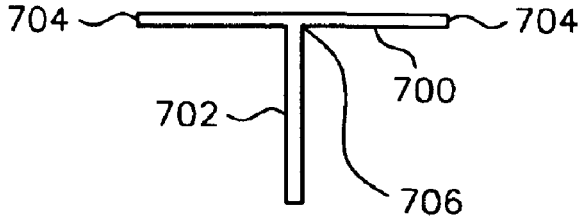
FIGS. 7A–7F are side plan views of exemplary cross-sectional shapes for 3D woven forms produced using the exemplary loom of FIG. 2.
Figure 7B:
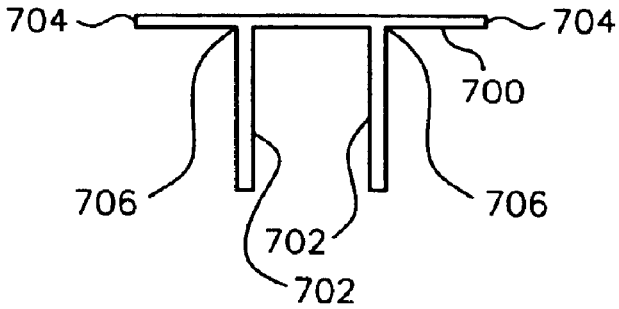
Figure 7C:
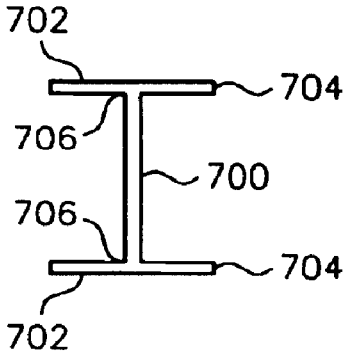
Figure 7D:
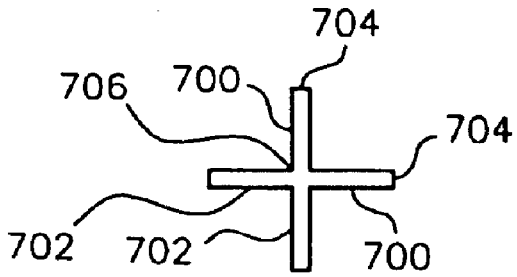

FIG. 7A shows a "T" cross-section. FIGS. 7B and 7C show "Pi" and "I" cross-sections, respectively. These cross-sections include two additional fabric pieces 702 and two woven junctions 706. They may be woven in the same manner. FIG. 7D shows an "X" cross-section. This form preferably includes two additional fabric pieces 702 connected to the first fabric piece 700 at a single woven junction 706.

Figure 7E:
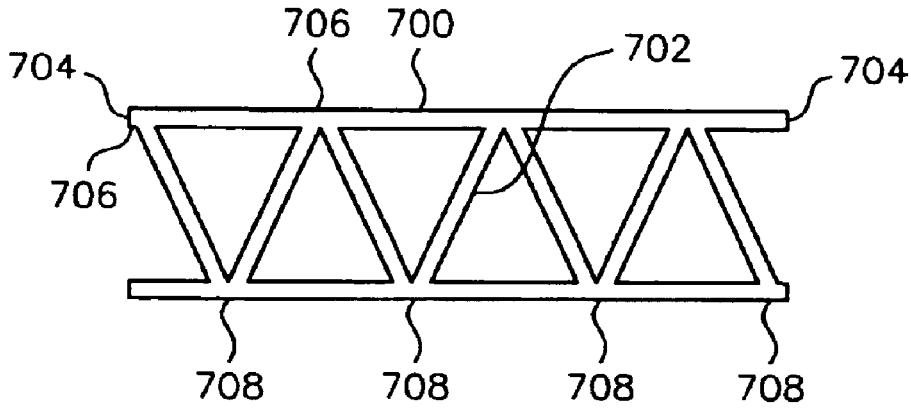

FIG. 7E shows a truss-core cross-section. This cross-section includes a plurality of additional fabric pieces 702, which are coupled to the first fabric piece 700 at woven junctions 706 of either a single additional fabric piece 702 or two additional fabric pieces 702. It is noted that a woven junction 706 of this structure may coincide substantially with a selvedge 704 of the first fabric piece 700. This structure, as well as the structure in FIG. 7F, also includes woven junctions 708 in which two or more additional fabric pieces 702 are coupled. Although the structure shown in FIG. 7E has a single truss-core layer, it is contemplated that truss-core structures of more than one such layer may be formed.

Figure 7F:
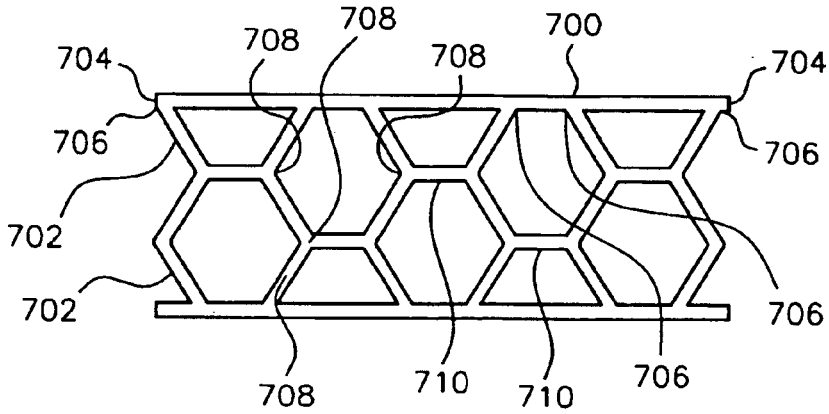

FIG. 7F shows a honeycomb cross-sectional pattern. This structure includes further additional fabric pieces 710 which are not coupled directly to the first fabric piece 700, but only to additional fabric pieces 702 at woven junctions 708. As with the previously described truss-core structure, multiple honeycomb layers may be formed and the structure shown in FIG. 7F is only exemplary.

Figure 8:
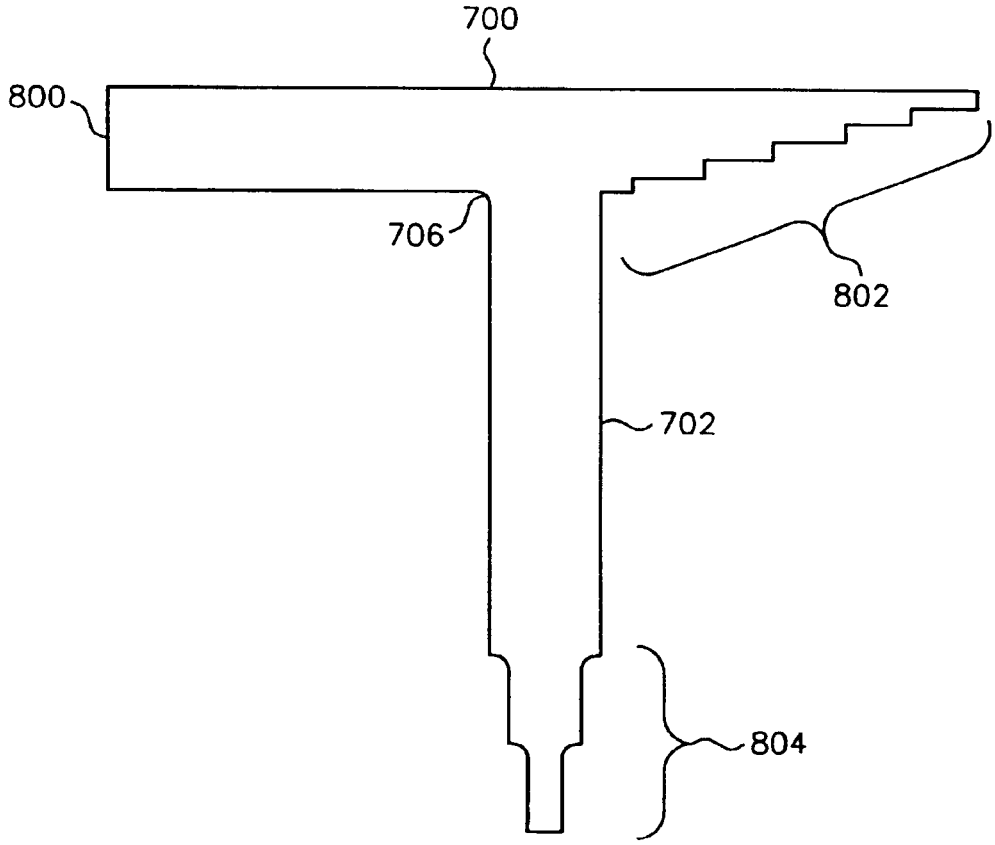
FIG. 8 is a side plan view of an exemplary, multi-layer, 3D, woven form illustrating exemplary tapered selvedges.
Figure 9A:
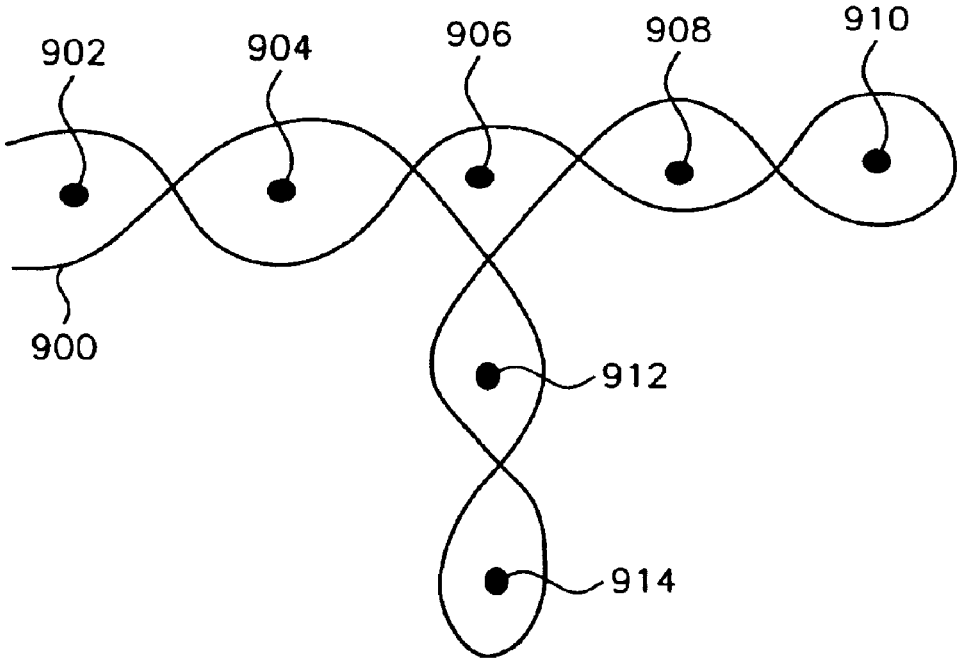
FIG. 9A (Prior Art)
FIG. 9A illustrates a simple 3D form, a "T," which may be woven using a conventional Jacquard-control system.
Figure 9B:
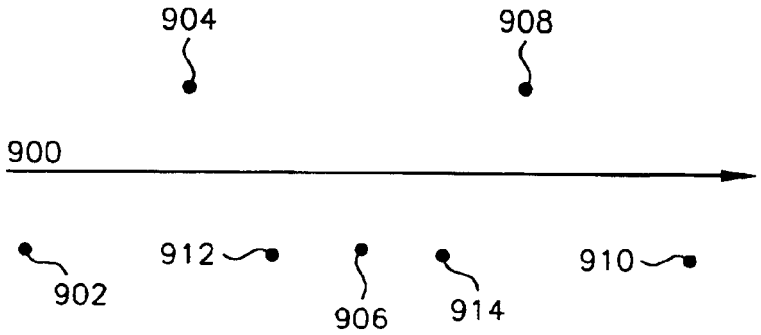
FIG. 9B (Prior Art)
FIGS. 9B–9E show the sequential steps used to weave the form shown in FIG. 9A.
Figure 9C:
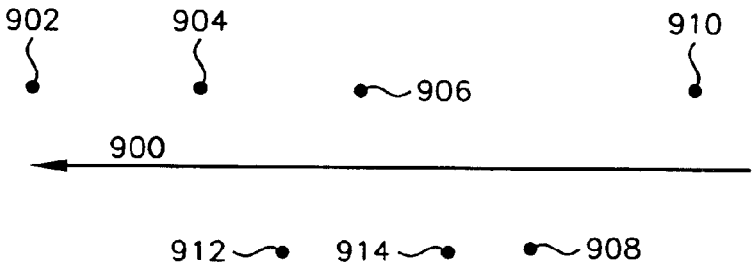
FIG. 9C (Prior Art)
Figure 9D:
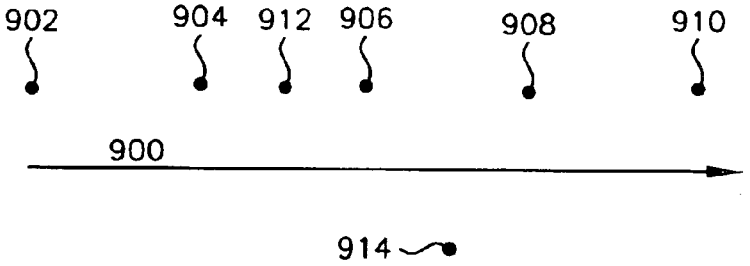
FIG. 9D (Prior Art)
Figure 9E:
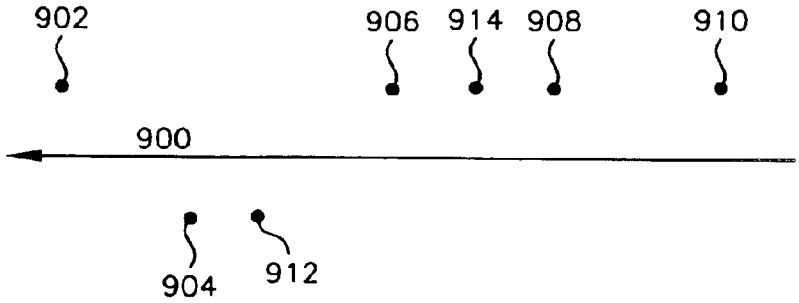
FIG. 9E (Prior Art)
Figure 10:
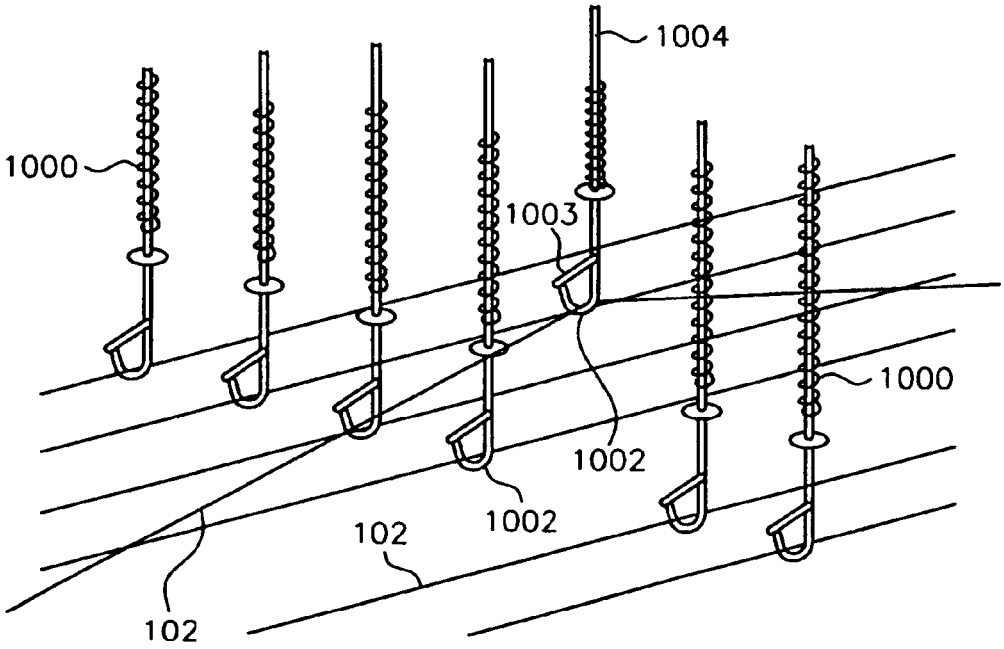
FIG. 10 (Prior Art)
FIG. 10 shows a conventional Jacquard-control system illustrating a series of individual heddles holding warp yarns.

FIG. 8 shows a cross-sectional view of an exemplary, multi-layer "T" structure which may be formed by the exemplary loom 200 of FIG. 2. This structure illustrates three exemplary methods of tapering selvedges of a multi-layer formed woven using the exemplary loom 200. Both the first fabric piece 700 and the additional fabric piece 702 in the illustrated structure are shown having six interwoven layers. The first selvedge 800 is shown without any taper. The second selvedge 802 illustrates a taper from one side and the third selvedge 804 shows a taper on both sides.

It is also contemplated that the cross-sectional shape of a form may be changed during the weaving process, so that a form may include a "T" shaped portion and a "Pi" shaped portion, for example. In addition, the tapering or number of layers in a form may be changed during weaving.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A loom for weaving three dimensional structures which include a plurality of warp fibers, a fill fiber, and a plurality of bias fibers, the loom comprising:

a plurality of bias fiber holders, each bias fiber holder holding a bias fiber under tension;

a plurality of bias shuttles, each bias shuttle releasably gripping at least one of the plurality of bias fiber holders and translating horizontally, at a separate vertical position, the gripped bias fiber holders between a plurality of predetermined horizontal positions, at least one bias shuttle configured to translate above a shed formed by the warp fibers and at least one bias shuttle configured to translate below the shed; and a plurality of independently controllable bias arms, each independently controllable bias arm releasably gripping one of the plurality of bias fiber holders and translating the gripped bias fiber holder, at one of the predetermined horizontal positions, with a range of motion extending at least between two of the bias shuttles.

2. A loom for weaving three dimensional structures which include a plurality of warp fibers, a fill fiber, and a plurality of bias fibers, the loom comprising:

a plurality of heddles, each heddle engaging one of the plurality of warp fibers and independently translating the engaged warp fiber vertically between at least one upper warp position and at least one lower warp position, forming a shed;

a plurality of bias fiber holders, each bias fiber holder holding a bias fiber under tension;

a plurality of bias shuttles, each bias shuttle releasably gripping at least one of the plurality of bias fiber holders and translating horizontally, at a separate vertical position, the gripped bias fiber holders between a plurality of predetermined horizontal positions, at least one bias shuttle configured to translate above the shed and at least one bias shuttle configured to translate below the shed;

a plurality of independently controllable bias arms, each independently controllable bias arm releasably gripping one of the plurality of bias fiber holders and translating the gripped bias fiber holder, at one of the predetermined horizontal positions, with a range of motion extending at least between two of the bias shuttles;

a weave shuttle passing the fill fiber through the shed formed by the warp fibers and the bias fibers substantially along a centerline of the shed; and a reed for beat up.

3. The loom according to claim 2, wherein the plurality of heddles are Jacquard-controlled.

4. The loom according to claim 2, wherein the plurality of bias shuttles further includes at least one bias shuttle configured to translate within the shed.

5. The loom according to claim 2, wherein each bias fiber holder includes a ceramic lined vacuum cylinder to hold a bias fiber under tension.

6. The loom to claim 5, wherein each bias shuttle applies a vacuum to the ceramic lined vacuum cylinder of each bias fiber holder being translated by the bias shuttle.

7. The loom according to claim 2, wherein each bias fiber holder includes a plurality of tubes configured to be releasably gripped by at least one of the plurality of bias shuttles and the plurality of independently controllable bias arms.

8. The loom according to claim 7, wherein the plurality of tubes of each bias fiber holder include:

a pair of shuttle gripping tubes configured to be releasably gripped by the plurality of bias shuttles; and a pair of arm gripping tubes configured to be releasably gripped by the plurality of independently controllable bias arms.

9. The loom according to claim 2, wherein the plurality of predetermined horizontal positions are selected such that each of the plurality of warp fibers is between two of the predetermined horizontal positions.

10. The loom according to claim 2, wherein the plurality of independently controllable bias arms includes:

an upper subset of independently controllable bias arms, the range of motion of each independently controllable bias arm of the upper subset extending from above the shed to the centerline of the shed; and a lower subset of independently controllable bias arms, the range of motion of each independently controllable bias arm of the lower subset extending from below the shed to the centerline of the shed.

11. The loom according to claim 10, wherein:

a subset of the predetermined horizontal positions is selected to be located between pairs of warp fibers; and the independently controllable bias arms are configured such that one of the upper subset and one of the lower subset of the independently controllable bias arms in each of the subsets of the predetermined horizontal positions align to transfer a gripped bias fiber holder between the two aligned independently controllable bias arms at the centerline of the shed in one of the subsets of the predetermined horizontal positions.

12. A loom for weaving three dimensional structures which include a plurality of warp fibers, a fill fiber, and a plurality of bias fibers, the loom comprising:

a plurality of heddles, each heddle engaging one of the plurality of warp fibers and independently translating the engaged warp fiber vertically between at least one upper warp position and at least one lower warp position, forming a shed;

a plurality of bias fiber holders, each bias fiber holder including a ceramic lined vacuum cylinder configured to hold a bias fiber under tension;

a plurality of bias shuttles, each bias shuttle releasably gripping at least one of the plurality of bias fiber holders and translating horizontally, at a separate vertical position, the gripped bias fiber holders between a plurality of predetermined horizontal positions, at least one bias shuttle configured to translate above the shed, at least one bias shuttle configured to translate below the shed, and at least one bias shuttle configured to translate within the shed;

wherein the plurality of predetermined horizontal positions are selected such that each of the plurality of warp fibers is between two of the predetermined horizontal positions;

a plurality of independently controllable bias arms, each Independently controllable bias arm releasably gripping one of the plurality of bias fiber holders and translating the gripped bias fiber holder, at one of the predetermined horizontal positions, the plurality of independently controllable bias arms including;

an upper subset of independently controllable bias arms, the range of motion of each independently controllable bias arm of the upper subset extending from above the shed to the centerline of the shed; and a lower subset of independently controllable bias arms, the range of motion of each independently controllable bias arm of the lower subset extending from below the shed to the centerline of the shed with a range of motion extending at least between two of the bias shuttles;

wherein each bias fiber holder includes a plurality of tubes configured to be releasably gripped by at least one of the plurality of bias shuttles and the plurality of independently controllable bias arms;

a weave shuttle passing the fill fiber through the shed formed by the warp fibers and the bias fibers substantially along a centerline of the shed; and a reed for beat up.

13. The loom according to claim 12, wherein the plurality of heddles are Jacquard-controlled.

14. The loom according to claim 13, wherein each bias shuttle applies a vacuum to the ceramic lined vacuum cylinder of each bias fiber holder being translated by the bias shuttle.

15. The loom according to claim 13, wherein the plurality of tubes of each bias fiber holder include:

a pair of shuttle gripping tubes configured to be releasably gripped by the plurality of bias shuttles; and a pair of arm gripping tubes configured to be releasably gripped by the plurality of independently controllable bias arms.

16. The loom according to claim 13, wherein:

a subset of the predetermined horizontal positions is selected to be located between pairs of warp fibers; and the independently controllable bias arms are configured such that one of the upper subset and one of the lower subset of the independently controllable bias arms in each of the subsets of the predetermined horizontal positions align to transfer a gripped bias fiber holder between the two aligned independently controllable bias arms at the centerline of the shed in one of the subsets of the predetermined horizontal positions.

* * * * *